US008205281B2

(12) United States Patent
Swierski et al.

(10) Patent No.: US 8,205,281 B2
(45) Date of Patent: Jun. 26, 2012

(54) REMOVABLE BED, MATTRESS, AND SEAT WRAPS WITH INTEGRATED STORAGE COMPARTMENTS

(76) Inventors: Scott T. Swierski, Waxhaw, NC (US); Dawn M. Swierski, Waxhaw, NC (US)

( * ) Notice: Subject to any disclaimer, the term of this patent is extended or adjusted under 35 U.S.C. 154(b) by 288 days.

(21) Appl. No.: 12/401,940

(22) Filed: Mar. 11, 2009

(65) Prior Publication Data

US 2009/0229052 A1 Sep. 17, 2009

Related U.S. Application Data

(60) Provisional application No. 61/035,538, filed on Mar. 11, 2008.

(51) Int. Cl.
*A47G 9/04* (2006.01)
*A47G 9/02* (2006.01)

(52) U.S. Cl. ..... 5/485; 5/482; 297/188.2; 297/224

(58) Field of Classification Search ..... 5/485, 482, 5/493, 496, 498; 297/188.2, 224
See application file for complete search history.

(56) References Cited

U.S. PATENT DOCUMENTS

| | | | | |
|---|---|---|---|---|
| 2,284,778 | A * | 6/1942 | Treiber | 5/498 |
| 3,295,887 | A * | 1/1967 | Bacon | 297/188.2 |
| 4,131,313 | A * | 12/1978 | Jacobs | 297/188.2 |
| 5,758,972 | A | 6/1998 | Mack et al. | |
| 5,815,861 | A * | 10/1998 | LaGrange et al. | 5/504.1 |
| 6,149,234 | A * | 11/2000 | Daniels | 297/229 |
| 6,189,968 | B1 * | 2/2001 | Emanuel et al. | 297/188.01 |
| 6,292,963 | B1 | 9/2001 | Couture | |
| 6,854,139 | B2 * | 2/2005 | Lamy | 5/485 |
| 7,131,152 | B2 | 11/2006 | Wootten, Jr. et al. | |
| 7,168,113 | B1 * | 1/2007 | Olsen | 5/493 |

* cited by examiner

*Primary Examiner* — Michael Trettel

(57) ABSTRACT

The present invention provides removable bed, mattress, and seat wraps with integrated storage compartments. Advantageously, these removable bed, mattress, and seat wraps allow a user to place pockets and other storage compartments of and in a wide variety of configurations where they are desired with respect to a bed, mattress, seat, or the like, and remove these pockets and other storage compartments quickly and easily when desired. For example, the removable bed, mattress, and seat wraps of the present invention may be used in conjunction with the headboard of a bed, a mattress, a box spring, a home seat, a vehicle seat, a boat seat, or virtually any other suitable structure, stationary or mobile.

21 Claims, 7 Drawing Sheets

REMOVABLE BED, MATTRESS, AND SEAT WRAPS WITH INTEGRATED STORAGE COMPARTMENTS

CROSS-REFERENCE TO RELATED APPLICATION(S)

The present non-provisional patent application/patent claims the benefit of priority of U.S. Provisional Patent Application No. 61/035,538, filed on Mar. 11, 2008, and entitled "REMOVABLE MATTRESS AND SEAT WRAP WITH INTEGRATED STORAGE," the contents of which are incorporated in full by reference herein.

FIELD OF THE INVENTION

The present invention relates generally to removable bed, mattress, and seat wraps with integrated storage compartments. Advantageously, these removable bed, mattress, and seat wraps allow a user to place pockets and other storage compartments of and in a wide variety of configurations where they are desired with respect to a bed, mattress, seat, or the like, and remove these pockets and other storage compartments quickly and easily when desired.

BACKGROUND OF THE INVENTION

There is always a need to store various items in proximity to a bed, mattress, seat (home, vehicle, boat, etc.), or the like. Such items may include remote controls, glasses, reading materials, tissues, medications, flashlights, firearms, adult novelties, and the like. Conventional storage solutions include pocketed "flaps"—a portion of which tucks between the mattress and box spring of a bed or the cushion and base of a seat, pocketed "flaps" that fasten to the sheet or blanket of a bed or the fabric of a seat, and storage compartments that are integrally formed with the sheet or blanket of a bed or the fabric of a seat.

For example, U.S. Pat. No. 5,758,972 (Mack, et al.), by its own language, discloses a sundries caddy to hold sundries for use with a fastening arrangement in being suspended from a bed. A suspendable container portion of the caddy is held by a clampable portion over the edge of a mattress supported by a mismatched hooks and loops patches fastener adhered to the mattress support supplemented by the pressure of the mattress thereon and on much of the remainder of the clampable portion.

U.S. Pat. No. 6,292,963 (Couture), by its own language, discloses a bedding accessory system which includes a bed pocket having an opening therein and a fastening system which may be secured to the sheets of a bed without moving the mattress. The fastening system is a multipurpose one and may be adapted for different uses.

U.S. Pat. No. 6,854,139 (Lamy), by its own language, discloses a bed covering fastening system that provides for removable attachment of items such as storage pockets to a bed covering. The system includes a two part fastener, one part of which is integral with a bed covering and the other part of which is integral with an item to be attached to the bed covering. The fastener part integral with the bed covering is positioned so that attached items hang down along the side or end of a bed. There may be a number of fastener parts positioned in a spaced apart configuration around the bed covering so that an item may be attached to various locations on the bed covering and a number of items may be so attached. A reinforcing band may also be included on the bed covering to prevent tearing of the bed covering upon removal of the item.

The invention also contemplates that the item may be attached to a top covering, which may in turn be partly attached to a bottom covering. Also disclosed is a bed covering fastener system.

U.S. Pat. No. 7,131,152 (Wootten, Jr., et al.), by its own language, discloses an improved pocketed bed sheet that avoids inadvertent placement of objects in a pocket, better controls placement and removal of objects from within its pocket, and deters babies and toddlers from accessing such pocket, all without the need for engagement or disengagement of a fastening member. The improved pocketed bed sheet includes a fabric body configured to substantially cover a mattress and a pocket provided on the fabric body. The pocket includes a wall configured to hold objects in the pocket and a diagonal fabric edge that defines a diagonal opening for predetermined angular ingress and egress into the pocket for controlling the placement and removal of objects within the pocket. The diagonal fabric edge is disposed at an angle relative to an edge of the fabric body.

All of these conventional storage solutions, however, suffer from the fact that they are difficult to place, use, remove, reconfigure and/or clean; unnecessarily limit the variety of pocket configurations that may be enjoyed; and/or are significantly attached to or integrally formed with the sheet or blanket of a bed or the fabric of a seat—making them cumbersome and less than user friendly.

BRIEF SUMMARY OF THE INVENTION

In various exemplary embodiments, the present invention provides removable bed, mattress, and seat wraps with integrated storage compartments. Advantageously, these removable bed, mattress, and seat wraps allow a user to place pockets and other storage compartments of and in a wide variety of configurations where they are desired with respect to a bed, mattress, seat, or the like, and remove these pockets and other storage compartments quickly and easily when desired. For example, the removable bed, mattress, and seat wraps of the present invention may be used in conjunction with the headboard of a bed, a mattress, a box spring, a home seat, a vehicle seat, a boat seat, or virtually any other suitable structure, stationary or mobile.

In one exemplary embodiment, the present invention provides a removable storage wrap device configured to be disposed about an attachment object, including: one or more body material portions; one or more storage compartments fixedly or removably attached to the one or more body material portions; and one or more elastic material portions attached to the one or more body material portions; wherein the one or more body material portions and the one or more elastic material portions collectively form an adjustable band that is selectively disposed around the attachment object. Optionally, the removable storage wrap device also includes one or more opening mechanisms attached to one or more of the one or more body material portions and the one or more elastic material portions, wherein the one or more opening mechanisms are selectively utilized to close/open the adjustable band. Optionally, the removable storage wrap device further includes one or more adjustment mechanisms attached to one or more of the one or more body material portions and the one or more elastic material portions, wherein the one or more adjustment mechanisms are selectively utilized to adjust the size of the adjustable band. Optionally, the removable storage wrap device still further includes one or more spanning straps that attach a first side of the adjustable band to a second side of the adjustable band substantially underneath the attachment object. Optionally, the removable storage wrap device still further includes a hanging compartment associated with the one or more spanning straps. Optionally, one or more of the one or more storage compartments are substantially rigid. Optionally, the removable storage wrap device still further includes an attachment feature disposed around a perimeter of the adjustable band that allows the selective attachment of a decorative feature around the perimeter of the adjustable band. Preferably, the attachment object is one of a headboard of a bed, a mattress, a box spring, a residential seat, a vehicle seat, a boat seat, and an aircraft seat.

In another exemplary embodiment, the present invention provides a removable storage wrap device configured to be disposed about an attachment object, including: one or more body material portions; one or more storage compartments fixedly or removably attached to the one or more body material portions; and one or more attachment portions attached to the one or more body material portions; wherein the one or more body material portions and the one or more attachment portions collectively form an adjustable band that is selectively disposed around the attachment object. Optionally, the removable storage wrap device also includes one or more opening mechanisms attached to one or more of the one or more body material portions and the one or more attachment portions, wherein the one or more opening mechanisms are selectively utilized to close/open the adjustable band. Optionally, the removable storage wrap device further includes one or more adjustment mechanisms attached to one or more of the one or more body material portions and the one or more attachment portions, wherein the one or more adjustment mechanisms are selectively utilized to adjust the size of the adjustable band. Optionally, the removable storage wrap device still further includes one or more spanning straps that attach a first side of the adjustable band to a second side of the adjustable band substantially underneath the attachment object. Optionally, the removable storage wrap device still further includes a hanging compartment associated with the one or more spanning straps. Optionally, one or more of the one or more storage compartments are substantially rigid. Optionally, the removable storage wrap device still further includes an attachment feature disposed around a perimeter of the adjustable band that allows the selective attachment of a decorative feature around the perimeter of the adjustable band. Preferably, the attachment object is one of a headboard of a bed, a mattress, a box spring, a residential seat, a vehicle seat, a boat seat, and an aircraft seat.

In a further exemplary embodiment, the present invention provides a removable storage wrap device configured to be disposed about an attachment object, including: one or more elastic material portions; and one or more storage compartments fixedly or removably attached to the one or more elastic material portions; wherein the one or more elastic material portions form an adjustable band that is selectively disposed around the attachment object. Optionally, the removable storage wrap device also includes one or more opening mechanisms attached to one or more of the one or more elastic material portions, wherein the one or more opening mechanisms are selectively utilized to close/open the adjustable band. Optionally, the removable storage wrap device further includes one or more adjustment mechanisms attached to one or more of the one or more elastic material portions, wherein the one or more adjustment mechanisms are selectively utilized to adjust the size of the adjustable band. Optionally, the removable storage wrap device still further includes one or more spanning straps that attach a first side of the adjustable band to a second side of the adjustable band substantially underneath the attachment object. Optionally, the removable storage wrap device still further includes a hanging compartment associated with the one or more spanning straps. Optionally, the one or more storage compartments are substantially rigid. Optionally, the removable storage wrap device still further includes an attachment feature disposed around a perimeter of the adjustable band that allows the selective attachment of a decorative feature around the perimeter of the adjustable band. Preferably, the attachment object is one of a headboard of a bed, a mattress, a box spring, a residential seat, a vehicle seat, a boat seat, and an aircraft seat.

BRIEF DESCRIPTION OF THE DRAWINGS

The present invention is illustrated and described herein with reference to the various drawings, in which like reference numbers are used to denote like device components/method steps, as appropriate, and in which.

DETAILED DESCRIPTION OF THE INVENTION

In various exemplary embodiments, the present invention provides removable bed, mattress, and seat wraps with integrated storage compartments. Advantageously, these removable bed, mattress, and seat wraps allow a user to place pockets and other storage compartments of and in a wide variety of configurations where they are desired with respect to a bed, mattress, seat, or the like, and remove these pockets and other storage compartments quickly and easily when desired. For example, the removable bed, mattress, and seat wraps of the present invention may be used in conjunction with the headboard of a bed, a mattress, a box spring, a home seat, a vehicle seat, a boat seat, or virtually any other suitable structure, stationary or mobile.

Figure 1:
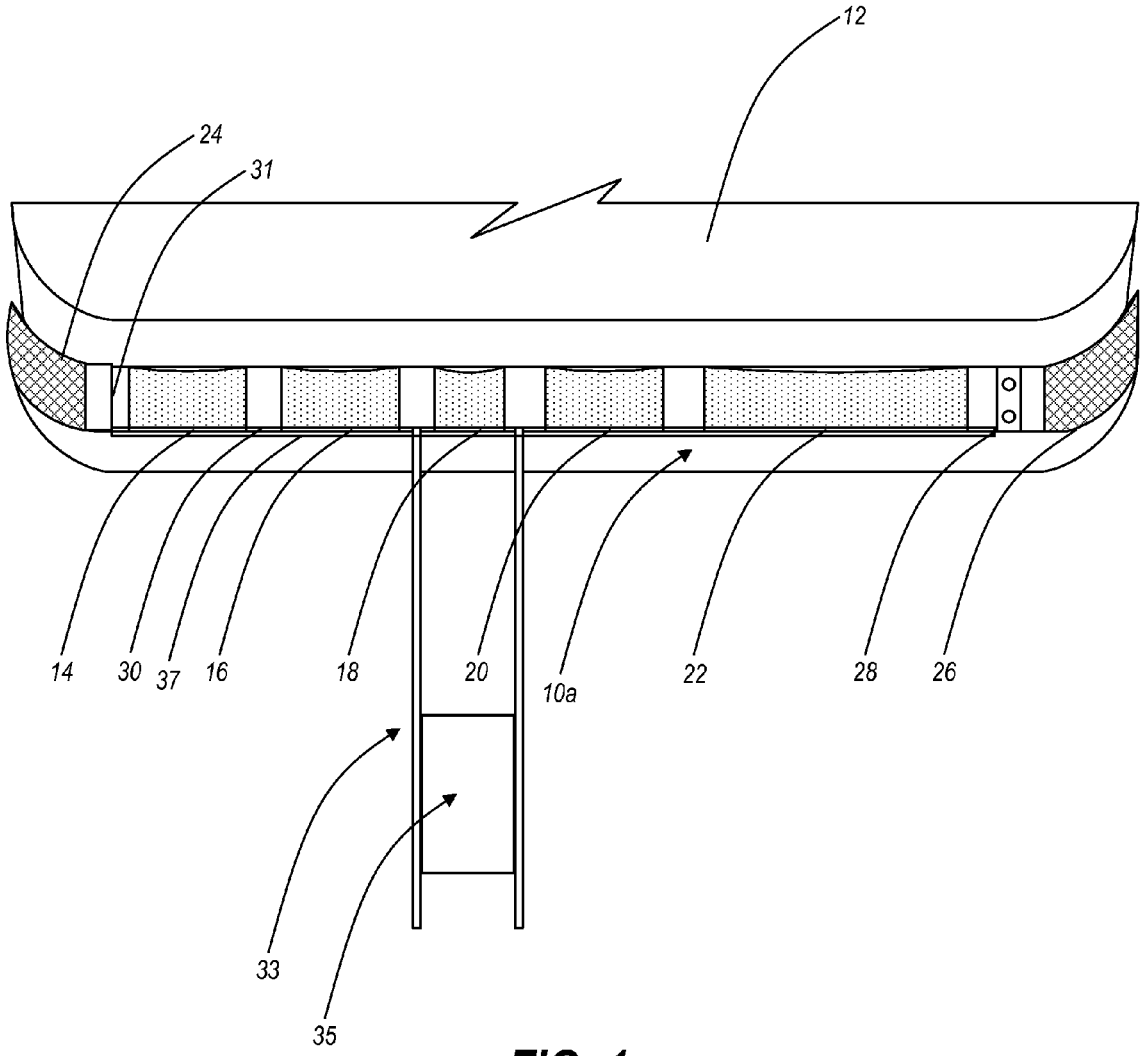
FIG. 1 is a partial schematic view of one exemplary embodiment of the removable storage wrap device of the present invention—wrapped around a mattress and sheet or other similar structure(s)

Referring to FIG. 1, in one exemplary embodiment, the removable storage wrap device 10*a* of the present invention is illustrated wrapped around a mattress 12 or other similar structure. The removable storage wrap device 10*a* is capable of being placed over/around sheets, blankets, comforters, etc. on the mattress 12 or other covers on other similar structures. Advantageously, the removable storage wrap device 10*a* may also be removed from the mattress 12 or other similar structures without removing these sheets, blankets, comforters, other covers, etc., when they are present. The removable storage wrap device 10*a* includes integrated or otherwise attached storage compartments 14, 16, 18, 20, and 22 of varying exemplary sizes/shapes/configurations that allow for the storage of virtually any items.

The removable storage wrap device 10*a* includes alternating, overlapping, or unified sections of an elastic material 24 and 26 and a body material 30 that enable the removable storage wrap device 10*a* to conform to various sized structures and to provide the tension required to secure the removable storage wrap device 10*a* to these structures. For example, sections of the elastic material 24 and 26 may be sewn or otherwise coupled, directly or indirectly, to sections of the body material 30 to form a closed or broken loop. The body material 30 may form a closed or broken loop that is gathered around its top and/or bottom edges with the elastic material 24 and 26, which is coextensive with the body material 30. Sections of either the elastic material 24 and 26 and/or the body material 30 may be sewn or otherwise coupled, directly or indirectly, to any number of nylon or other non-elastic straps including any number of fasteners and/or adjustment mechanisms 31. In any event, the removable storage wrap device 10*a* may be conveniently sized to fit various sized mattresses 12, such as twin, full, queen, king, etc., beds, seats, or the like. Alternatively, the elastic material 24 and 26 may also extend around the entire perimeter of the mattress 12 and form the entire body material 30 of the removable storage wrap device 10*a*.

The storage compartments 14, 16, 18, 20, and 22 may be wholly or partially fixedly (e.g. sewn, glued, etc.), removably (e.g. hooked, snapped, buttoned, hook-and-loop fastened, etc.), or movably (e.g. slidingly) fastened to the elastic material 24 and 26 and/or body material 30. For example, the storage compartments 14, 16, 18, 20, and 22 may be wholly or partially fixedly or removably fastened to the body material 30 disposed adjacent to the sides of the mattress 12. Alternatively, the storage compartments 14, 16, 18, 20, and 22 may be integrally formed between multiple layers of the elastic material 24 and 26 and/or body material 30. Both the elastic material 24 and 26 and body material 30 may include any suitable commercially available materials used for making other similar storage devices for indoor and/or outdoor use. Preferably, both the elastic material 24 and 26 and body material 30 consist of a durable flexible or semi-rigid material that is capable of resisting stresses, tears, and stains, and likely one that is washable. Optionally, the storage compartments 14, 16, 18, 20, and 22 each include a zipper, snap, flap with a button, hook-and-loop type closure, etc. suitable for securely closing the storage compartments 14, 16, 18, 20, and 22, as opposed to them just remaining open on the top, front, or side, which is also a possibility. Any suitable shapes/configurations may be utilized.

The removable storage wrap device 10*a* may also include one or more opening mechanisms 28 to selectively open/close the removable storage wrap device 10*a*. These opening mechanism(s) 28 may include zippers, snaps, buttons, hook-and-loop type closures, etc. The opening mechanism(s) 28 may be included on one, two, three, or all "sides" of the removable storage wrap device 10*a*. The opening mechanism (s) 28, when used, assist the user in placing and removing the removable storage wrap device 10*a* on/from the mattress 12 or other structure. Alternatively, the removable storage wrap device 10*a* may omit the opening mechanism(s) 28 and instead be placed around the mattress 12 or other structure by extending the elastic material 24 and 26.

Figure 2:
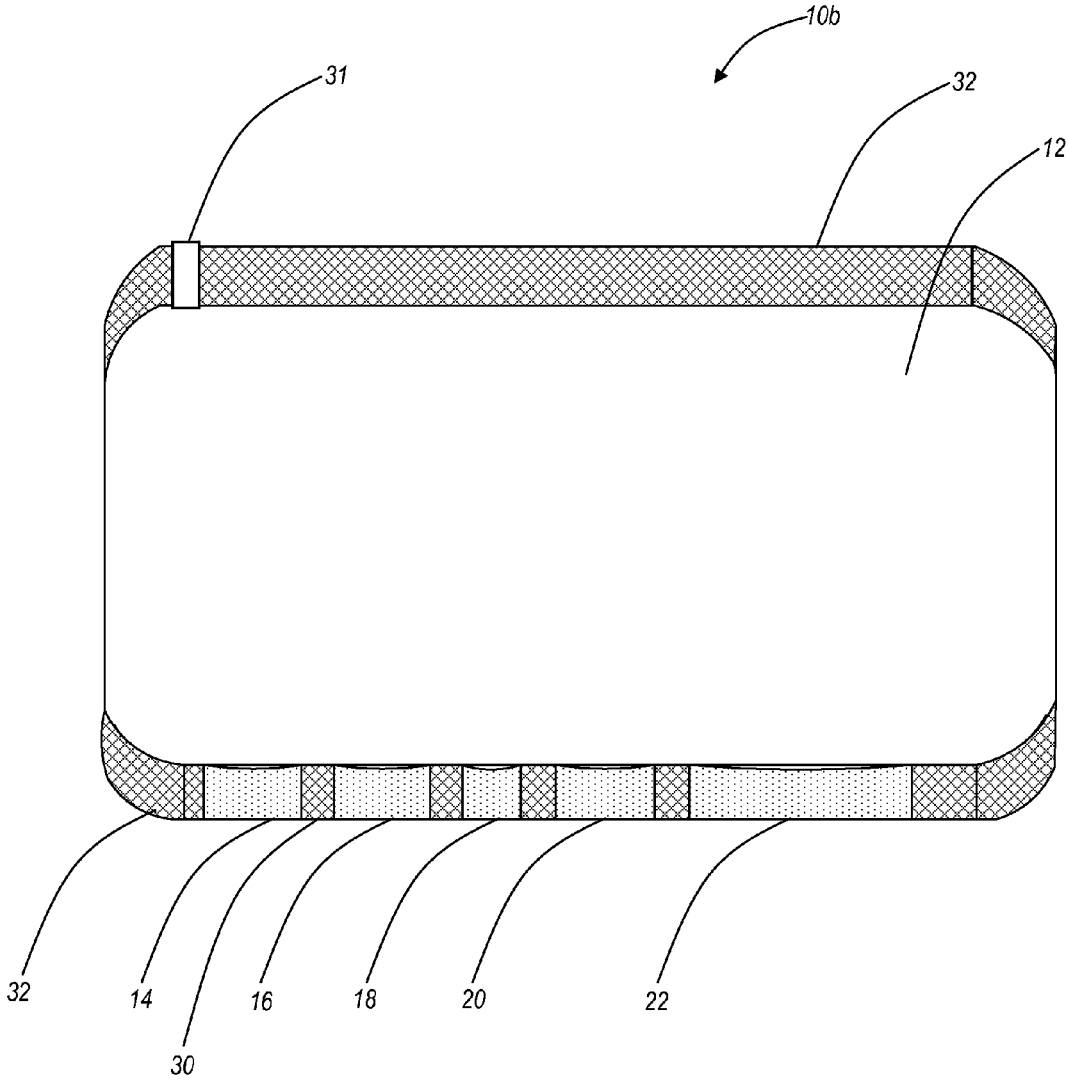
FIG. 2 is a schematic view of another exemplary embodiment of the removable storage wrap device of the present invention—again wrapped around a mattress and sheet or other similar structure(s)

Referring to FIG. 2, in another exemplary embodiment, the removable storage wrap device 10*b* of the present invention is illustrated wrapped around a mattress 12 or other similar structure. The removable storage wrap device 10*b* is capable of being placed over/around sheets, blankets, comforters, etc. on the mattress 12 or other covers on other similar structures. Advantageously, the removable storage wrap device 10*b* may also be removed from the mattress 12 or other similar structures without removing these sheets, blankets, comforters, other covers, etc., when they are present. The removable storage wrap device 10*b* includes integrated or otherwise attached storage compartments 14, 16, 18, 20, and 22 of varying exemplary sizes/shapes/configurations that allow for the storage of virtually any items.

The removable storage wrap device 10*b* includes alternating, overlapping, or unified sections of an elastic material 32 and a body material 30 that enable the removable storage wrap device 10*b* to conform to various sized structures and to provide the tension required to secure the removable storage wrap device 10*b* to these structures. For example, sections of the elastic material 32 may be sewn or otherwise coupled, directly or indirectly, to sections of the body material 30 to form a closed or broken loop. The body material 30 may form a closed or broken loop that is gathered around its top and/or bottom edges with the elastic material 32, which is coextensive with the body material 30. Sections of either the elastic material 32 and/or the body material 30 may be sewn or otherwise coupled, directly or indirectly, to any number of nylon or other non-elastic straps including any number of fasteners and/or adjustment mechanisms 31. In any event, the removable storage wrap device 10*b* may be conveniently sized to fit various sized mattresses 12, such as twin, full, queen, king, etc., beds, seats, or the like. Alternatively, the elastic material 32 may also extend around the entire perimeter of the mattress 12 and form the entire body material 30 of the removable storage wrap device 10*b*.

The storage compartments 14, 16, 18, 20, and 22 may be wholly or partially fixedly (e.g. sewn, glued, etc.) or removably (e.g. hooked, snapped, buttoned, hook-and-loop fastened, etc.) fastened to the elastic material 32 and/or body material 30. For example, the storage compartments 14, 16, 18, 20, and 22 may be wholly or partially fixedly or removably fastened to the body material 30 disposed adjacent to the sides of the mattress 12. Alternatively, the storage compartments 14, 16, 18, 20, and 22 may be integrally formed between multiple layers of the elastic material 32 and/or body material 30. Both the elastic material 32 and body material 30 may include any suitable commercially available materials used for making other similar storage devices for indoor and/or outdoor use. Preferably, both the elastic material 32 and body material 30 consist of a durable flexible or semi-rigid material that is capable of resisting stresses, tears, and stains, and likely one that is washable. Optionally, the storage compartments 14, 16, 18, 20, and 22 each include a zipper, snap, flap with a button, hook-and-loop type closure, etc. suitable for securely closing the storage compartments 14, 16, 18, 20, and 22, as opposed to them just remaining open on the top, front, or side, which is also a possibility. Any suitable shapes/configurations may be utilized.

The removable storage wrap device 10*b* may also include one or more opening mechanisms (not illustrated) to selectively open/close the removable storage wrap device 10*b*. These opening mechanism(s) may include zippers, snaps, buttons, hook-and-loop type closures, etc. The opening mechanism(s) may be included on one, two, three, or all "sides" of the removable storage wrap device 10*b*. The opening mechanism(s), when used, assist the user in placing and removing the removable storage wrap device 10*b* on/from the mattress 12 or other structure. Alternatively, the removable storage wrap device 10*b* may omit the opening mechanism(s) and instead be placed around the mattress 12 or other structure by extending the elastic material 32.

Figure 3:
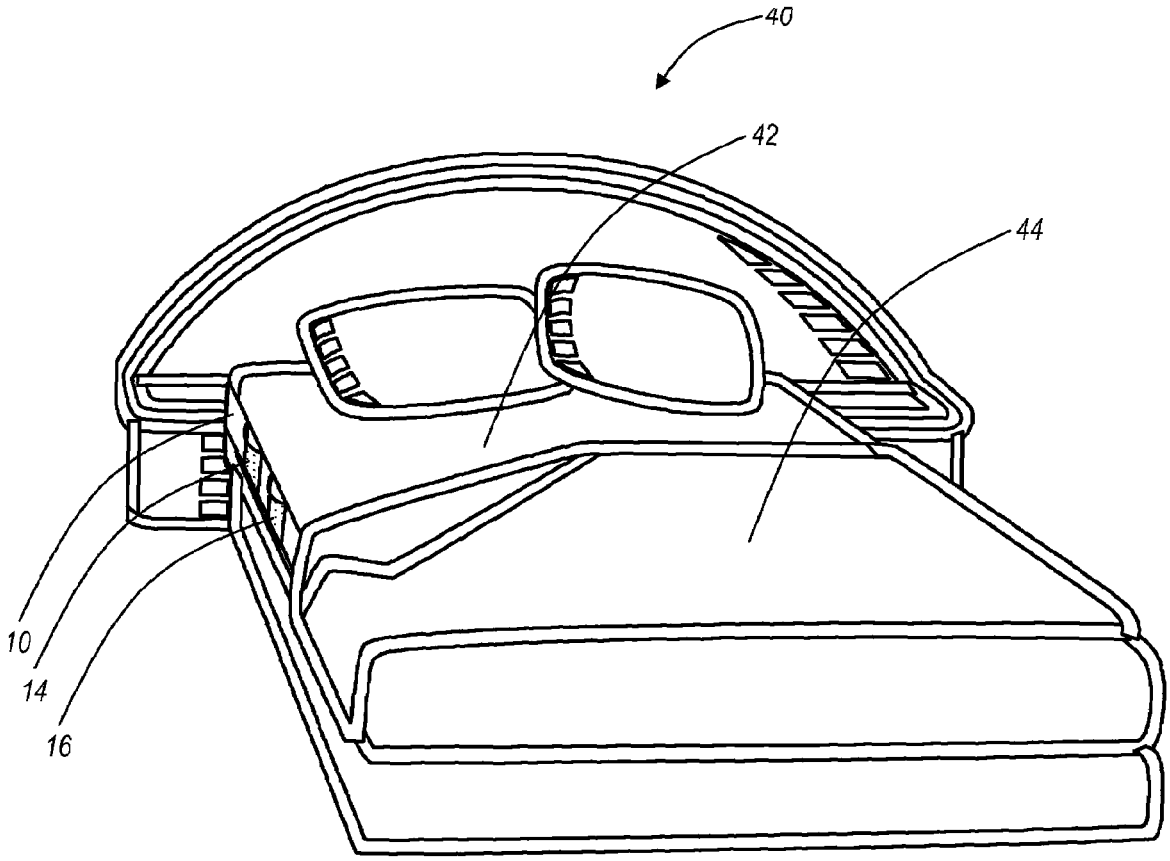
FIG. 3 is a perspective view of the removable storage wrap device of FIGS. 1 and 2—again wrapped around a mattress and sheet or other similar structure(s)

Referring to FIG. 3, a bed 40 is illustrated equipped with the removable storage wrap device 10 according to an exemplary embodiment of the present invention. The removable storage wrap device 10 includes the storage compartments 14 and 16 located on the side of the bed 40. The storage compartments 14 and 16 provide a convenient and safe storage location for a variety of personal and security items. Advantageously, the removable storage wrap device 10 is separate from the bed 40 and sheets 42 and a comforter 44 disposed on the bed 40. This enables the removable storage wrap device 10 to be added/removed without interfering with the sheets 42 and comforter 44, such as while washing the sheets 42. Further, this enables the removable storage wrap device 10 to be used on different beds 40 at different times, as requirements warrant.

Figure 4:
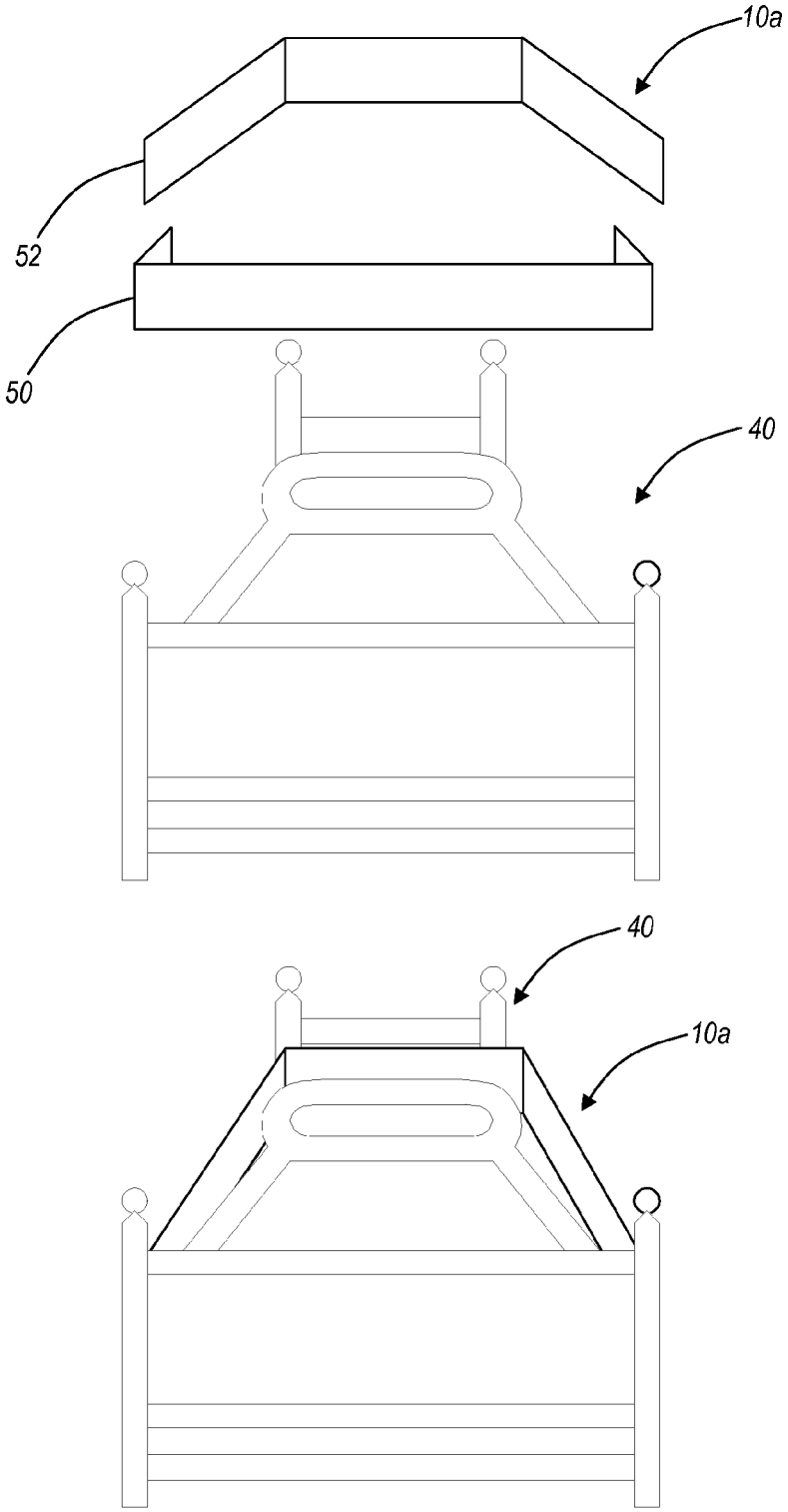
FIG. 4 is a perspective view of the removable storage wrap device of FIG. 1 during an exemplary installation.

Referring to FIG. 4, the deployment and removal of the removable storage wrap device 10*a* with an opening mechanism 28 (FIG. 1) disposed on each side of the removable storage wrap device 10*a* is illustrated according to an exemplary embodiment of the present invention. Here, a foot portion 50 of the removable storage wrap device 10*a* is placed at the foot of the bed, and a head portion 52 of the removable storage wrap device 10*a* is placed at the head of the bed. The opening mechanisms 28 are subsequently closed, forming a closure on the removable storage wrap device 10*a* around the bed 40. Conversely, the removable storage wrap device 10*a* may be removed by opening the opening mechanisms 28, and removing both portions 50 and 52 from the bed 40.

Figure 5:
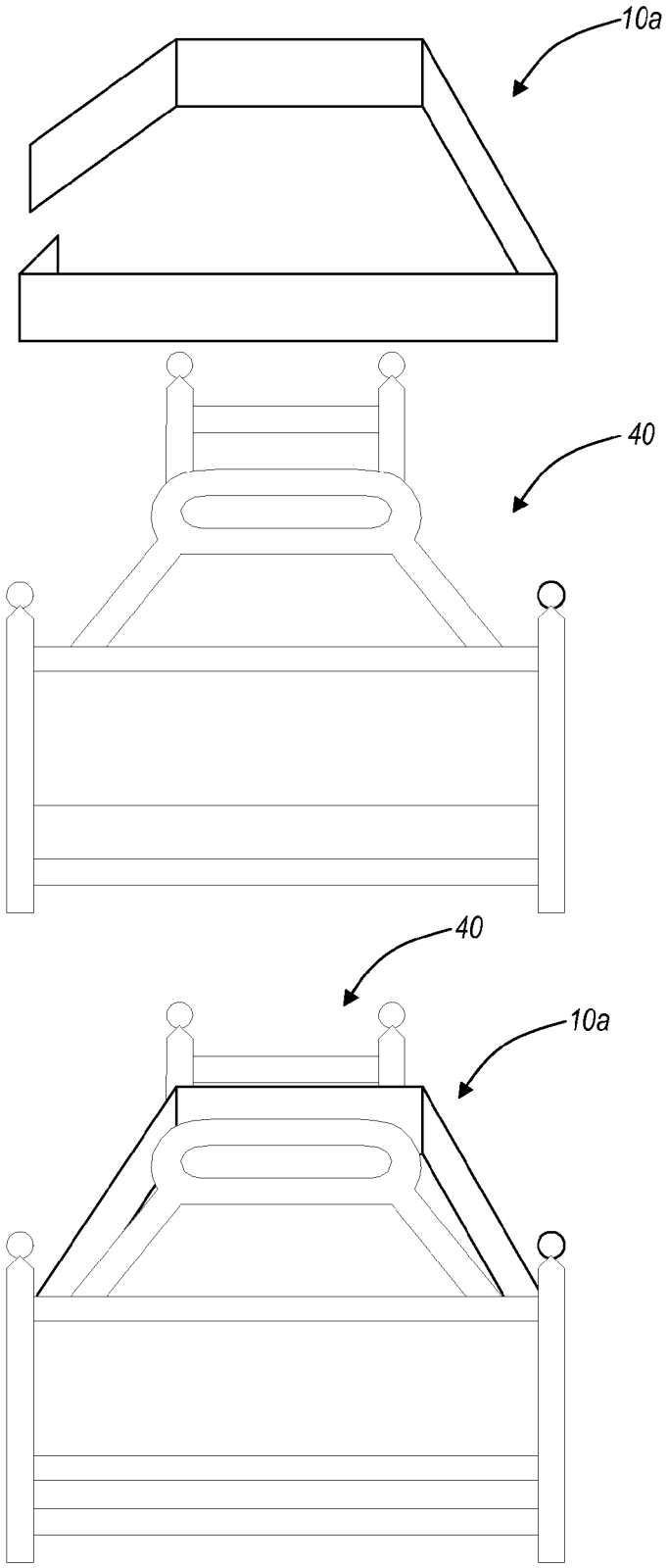
FIG. 5 is another perspective view of the removable storage wrap device of FIG. 1 during another exemplary installation.

Referring to FIG. 5, the deployment and removal of the removable storage wrap device 10*a* with one opening mechanism 28 (FIG. 1) on one side of the removable storage wrap device 10*a* is illustrated according to an exemplary embodiment of the present invention. Here, the removable storage wrap device 10*a* is a single unified device that opens and closes via the single opening mechanism 28. Each "side" of the removable storage wrap device 10*a* is placed around a side of the bed 40. The opening mechanism 28 is secured to form a closure on the removable storage wrap device 10*a* around the bed 40. Conversely, the removable storage wrap device 10*a* may be removed by opening the opening mechanism 28, and removing the removable storage wrap device 10*a* from the bed 40.

Figure 6:
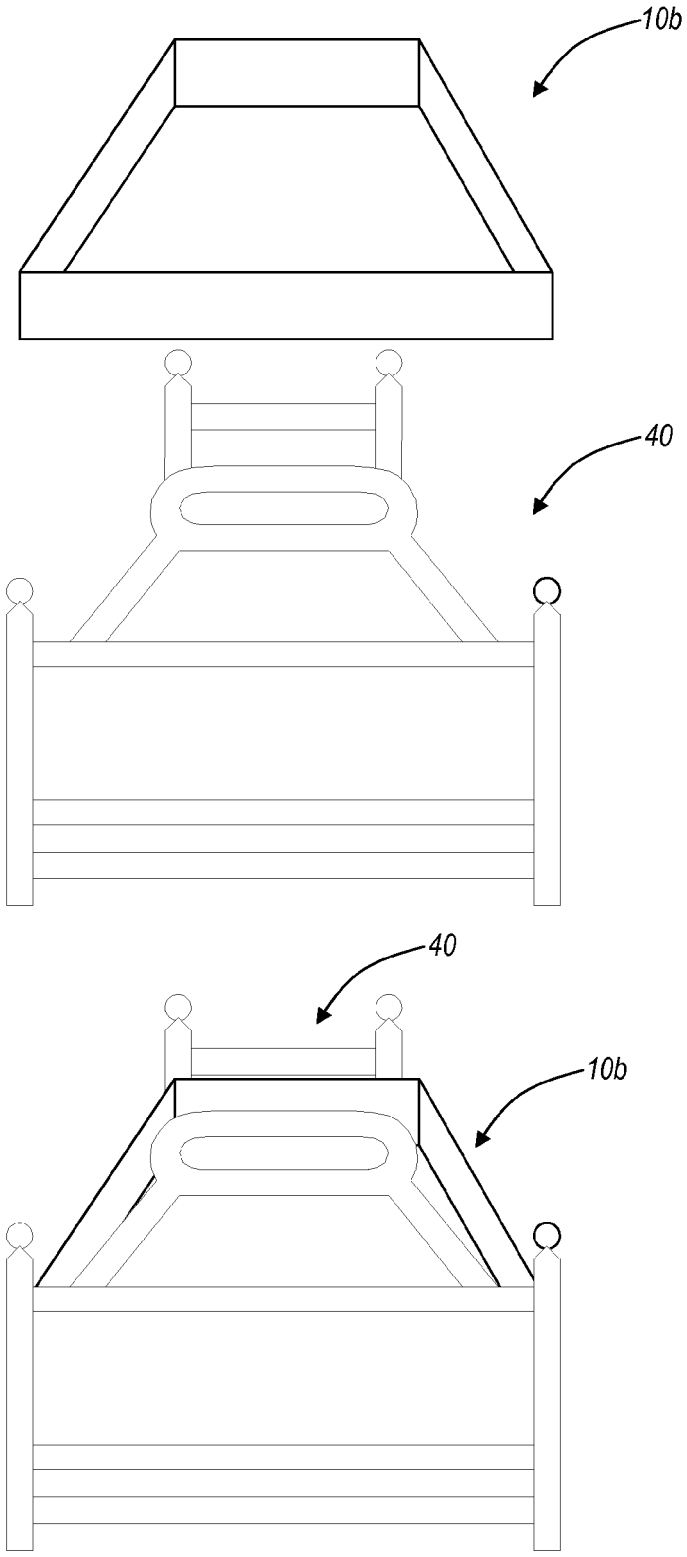
FIG. 6 is a perspective view of the removable storage wrap device of FIG. 2 during an exemplary installation.

Referring to FIG. 6, the deployment and removal of the removable storage wrap device 10*b* with the elastic material 32 on all sides of the removable storage wrap device 10*b* is illustrated according to an exemplary embodiment of the present invention. Here, the removable storage wrap device 10*b* is a single unified device, and the elastic material 32 forming the "sides" of the removable storage wrap device 10*b* enables the removable storage wrap device 10*b* to conform to the size/configuration of the bed 40. The removable storage wrap device 10*b* is deployed by placing the removable storage wrap device 10*b* around all sides of the bed 40. Conversely, the removable storage wrap device 10*b* may be removed by simply stretching the elastic material 32 and removing the removable storage wrap device 10*b* from the bed 40.

Figure 7:
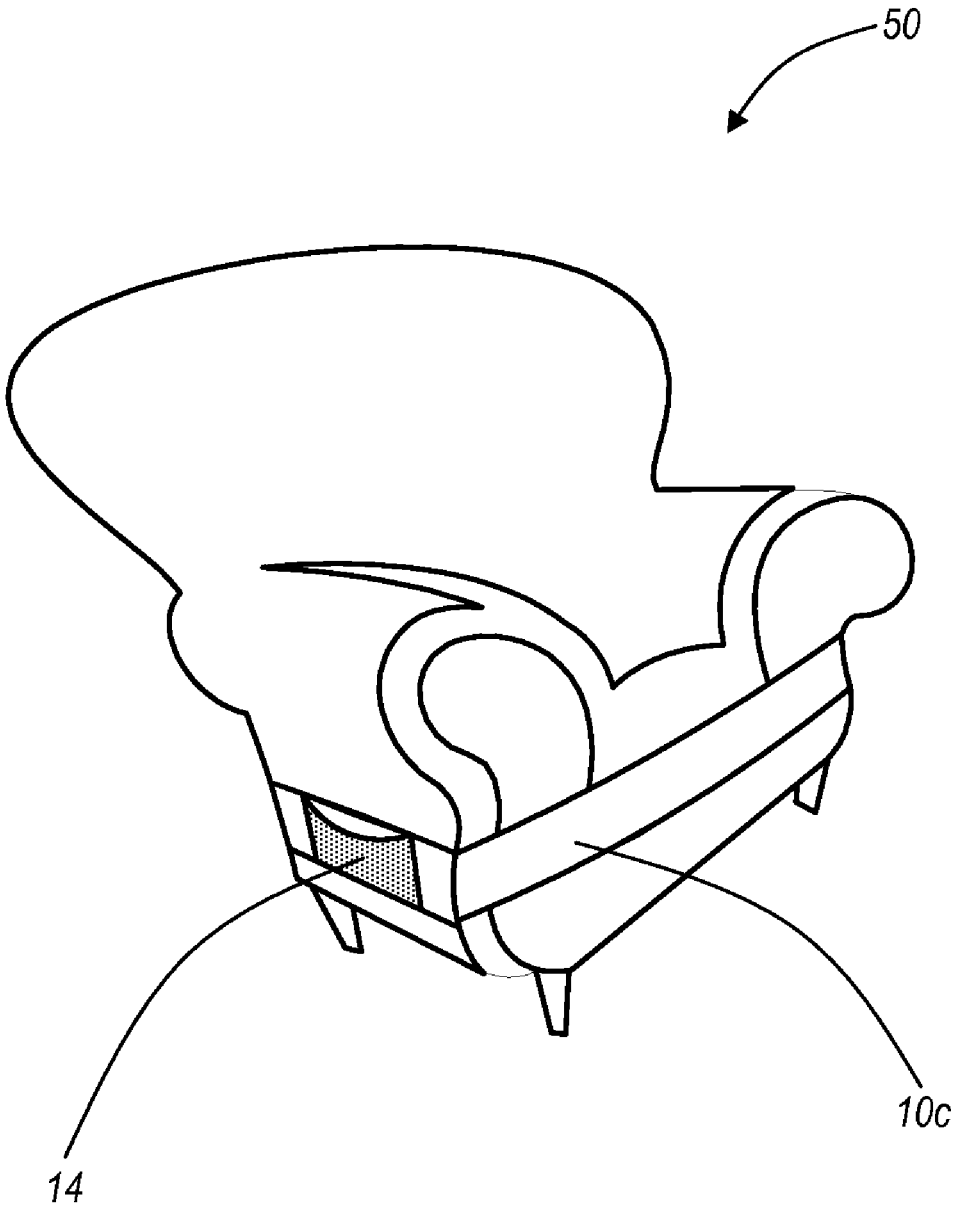
FIG. 7 is a perspective view of a further exemplary embodiment of the removable storage wrap device of the present invention—wrapped around a seat or other similar structure (s).

Referring to FIG. 7, a chair 50 is illustrated with the removable storage wrap device 10*c* according to an exemplary embodiment of the present invention. The removable storage wrap device 10*c* described herein may be in conjunction with various objects to add storage compartments on demand. It will be readily apparent to those of ordinary skill in the art that the removable storage wrap devices 10*a*, 10*b*, and 10*c* of the present invention may be utilized in conjunction with various objects to add storage compartments on demand. It should be noted that the removable storage wrap devices 10*a*, 10*b*, and 10*c* of the present invention are of various sizes/configurations, depending upon the intended use.

In alternative embodiments, the chair 50 could be a seat in an automobile, truck, recreational vehicle (RV), boat, aircraft, or the like. Likewise, the removable storage wrap devices 10*a*, 10*b*, and 10*c* could have a "hanging" compartment 35 (FIG. 1) that is disposed substantially under the attachment object, with appropriate straps 33 (FIG. 1) connecting the "hanging" compartment 35 to the opposite "side" of the removable storage wrap devices 10*a*, 10*b*, and 10*c*. Such a configuration might be especially useful with objects that the user wishes to keep concealed, such as a firearm or the like. These spanning straps 33 may also be used without the "hanging" compartment 35 to assist in securing the removable storage wrap devices 10*a*, 10*b*, and 10*c* to the attachment object. In a similar embodiment, the removable storage wrap devices 10*a*, 10*b*, and 10*c* may include one or more substantially rigid storage compartments used to hold a firearm or the like. Finally, the perimeter of the removable storage wrap devices 10*a*, 10*b*, and 10*c* may be equipped with an attachment feature 37 (FIG. 1) that allows the selective attachment of a bed skirt or other similar decorative feature.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A removable storage wrap device configured to be disposed about an attachment object, comprising:

one or more elastic material portions;

one or more storage compartments fixedly or removably attached to the one or more elastic material portions;

one or more attachment portions attached to the one or more elastic material portions;

wherein the one or more elastic material portions form an adjustable band that is selectively disposed around the attachment object; and one or more spanning straps that attach a first side of the adjustable band to a second side of the adjustable band substantially underneath the attachment object, with a hanging compartment associated with one or more spanning straps.

2. The removable storage wrap device of claim 1, further comprising one or more opening mechanisms attached to one or more of the one or more elastic material portions, wherein the one or more opening mechanisms are selectively utilized to close/open the adjustable band.

3. The removable storage wrap device of claim 1, further comprising one or more adjustment mechanisms attached to one or more of the one or more elastic material portions, wherein the one or more adjustment mechanisms are selectively utilized to adjust the size of the adjustable band.

4. The removable storage wrap device of claim 1, wherein one or more of the one or more storage compartments are substantially rigid.

5. The removable storage wrap device of claim 1, further comprising an attachment feature disposed around a perimeter of the adjustable band that allows the selective attachment of a decorative feature or a skirt feature around the perimeter of the adjustable band.

6. The removable storage wrap device of claim 1, wherein the attachment object comprises one of a headboard of a bed, a mattress, a box spring, a residential seat, a vehicle seat, a boat seat, and an aircraft seat.

7. A removable storage wrap device configured to be disposed about an attachment object, comprising:

one or more elastic material portions, wherein the one or more elastic material portions form an adjustable band that is selectively disposed around the sides of the attachment object; and one or more storage compartments removably attached to the adjustable band, wherein one or more of the one or more storage compartments are substantially rigid.

8. The removable storage wrap device of claim 7, further comprising one or more opening mechanisms attached to one or more of the one or more elastic material portions, wherein the one or more opening mechanisms are selectively utilized to close/open the adjustable band.

9. The removable storage wrap device of claim 7, further comprising one or more adjustment mechanisms attached to one or more of the one or more elastic material portions, wherein the one or more adjustment mechanisms are selectively utilized to adjust the size of the adjustable band.

10. The removable storage wrap device of claim 7, further comprising one or more spanning straps that attach a first side of the adjustable band to a second side of the adjustable band substantially underneath the attachment object.

11. The removable storage wrap device of claim 10, further comprising a hanging compartment associated with the one or more spanning straps.

12. The removable storage wrap device of claim 7, further comprising an attachment feature disposed around a perimeter of the adjustable band that allows the selective attachment of a decorative feature or a skirt feature around the perimeter of the adjustable band.

13. The removable storage wrap device of claim 7, wherein the attachment object comprises one of a headboard of a bed, a mattress, a box spring, a residential seat, a vehicle seat, a boat seat, and an aircraft seat.

14. A removable storage wrap device configured to be disposed about an attachment object, comprising:

one or more elastic material portions, wherein the one or more elastic material portions form an adjustable band that is selectively disposed around the sides of the attachment object;

one or more storage compartments movably and slidably fastened to the adjustable band; and one or more attachment portions attached to the one or more elastic material portions.

15. The removable storage wrap device of claim 14, further comprising one or more opening mechanisms attached to one or more of the one or more elastic material portions and the one or more attachment portions, wherein the one or more opening mechanisms are selectively utilized to close/open the adjustable band.

16. The removable storage wrap device of claim 14, further comprising one or more adjustment mechanisms attached to one or more of the one or more elastic material portions and the one or more attachment portions, wherein the one or more adjustment mechanisms are selectively utilized to adjust the size of the adjustable band.

17. The removable storage wrap device of claim 14, further comprising one or more spanning straps that attach a first side of the adjustable band to a second side of the adjustable band substantially underneath the attachment object.

18. The removable storage wrap device of claim 17, further comprising a hanging compartment associated with the one or more spanning straps.

19. The removable storage wrap device of claim 18, wherein one or more of the one or more storage compartments are substantially rigid.

20. The removable storage wrap device of claim 14, further comprising an attachment feature disposed around a perimeter of the adjustable band that allows the selective attachment of a decorative feature or a skirt feature around the perimeter of the adjustable band.

21. The removable storage wrap device of claim 14, wherein the attachment object comprises one of a headboard of a bed, a mattress, a box spring, a residential seat, a vehicle seat, a boat seat, and an aircraft seat.

* * * * *